United States Patent [19]

Williams

[11] 4,331,075

[45] May 25, 1982

[54] VALUE SETTING MECHANISM, PARTICULARLY FOR FRANKING MACHINES

[75] Inventor: Thomas D. Williams, Billericay, England

[73] Assignee: Vickers Limited, London, England

[21] Appl. No.: 118,322

[22] Filed: Feb. 4, 1980

[30] Foreign Application Priority Data

Feb. 5, 1979 [GB] United Kingdom ..... 7903987

[51] Int. Cl.[3] ..... B41J 7/08; B41J 7/96; B41J 29/70; B41L 47/56

[52] U.S. Cl. ..... 101/91

[58] Field of Search ..... 101/45, 91, 269; 235/58 P

[56] References Cited

U.S. PATENT DOCUMENTS

| | | | |
|---|---|---|---|
| 3,563,171 | 2/1971 | Heisner et al. | 101/45 |
| 3,589,281 | 6/1971 | Woodhead | 101/91 |
| 3,623,426 | 11/1971 | Gruss | 101/45 |
| 3,823,666 | 7/1974 | Hanson | 101/45 |
| 3,824,922 | 7/1974 | Van Acker | 101/45 |
| 3,826,190 | 7/1974 | Zofchak | 101/45 |
| 3,865,026 | 2/1975 | Trout | 101/45 |
| 3,881,411 | 5/1975 | Araki et al. | 101/45 |
| 4,050,374 | 9/1977 | Check | 101/91 |
| 4,056,054 | 11/1977 | Feldman | 101/45 |

*Primary Examiner*—William Pieprz

*Attorney, Agent, or Firm*—Shoemaker and Mattare, Ltd.

[57] ABSTRACT

A value setting mechanism constituting an interface between printing mechanism and an electronic accounting system in a franking machine has each value precisely set without possibility of alteration during a printing cycle. A four digit value can be set by rotating thumb wheels that transmit the value to encoding switches and printing elements. A spring loaded locking bar lies between aligned recesses on the wheels when properly set. To initiate a cycle a trip lever is electromagnetically moved from a first position to a second position releasing a clutch pawl to actuate the printing elements via a clutch and to close switches. If bar fails to enter aligned recesses, a detent unit prevents the trip lever from moving to the second position. When it does so move, an arm thereon inhibits detent unit from moving in a direction to allow bar to withdraw from the aligned recesses.

7 Claims, 6 Drawing Figures

VALUE SETTING MECHANISM, PARTICULARLY FOR FRANKING MACHINES

FIELD OF THE INVENTION

This invention relates to value setting mechanisms designed primarily, but not exclusively, for use in postal franking machines.

In a franking machine a value has to be set for each item of mail fed into the machine. The value, which in the United Kingdom is usually up to 999½, can be altered as required by hand. This value is automatically communicated to a mechanism that prints on items of mail an inked franking impression in accordance with the requirements laid down by International Post Offices. The value is also automatically communicated to an accounting side of the machine including a descending register containing the sum of postage value credited for the customer and an ascending register containing the accumulated sum of postal value used.

Where the accounting side of a franking machine is to be basically an electronic system, the value setting mechanism must provide an effective interface between the printing mechanism and the electronic system. Furthermore it is essential for the machine to be rendered inoperative by simple means in the event of a value being ambiguously set or set without precision. In addition, it is essential that the value cannot be altered while the printing and accounting cycle is in process. The present invention provides means whereby these requirements can be fulfilled.

SUMMARY OF THE INVENTION

According to the invention, a value setting mechanism comprises a plurality of coaxially mounted relatively rotatable members each having a series of operative positions about its axis respectively representing digital values and each member having a series of peripheral recesses allocated to the digital values, a locking bar loaded to bear against the peripheries of the members so as to enter any set of aligned recesses in all the members that can be selected by arranging the members in different relative positions, the locking bar and recesses being shaped for the locking bar only effectively to enter aligned recesses in such a way as to hold each member accurately in one of its operative positions, a trip member arranged, when in a first position, to inhibit the performance of a function associated with the positioning of the rotatable members and, when in a second position, to initiate the performance of the function, and a detent unit connected to the locking bar and mounted to maintain the trip member in its first position when the locking bar lies between two recesses in a member, and to be held by the trip member, when in its second position, in a position that locks the locking bar in a line of recesses. When the mechanism is arranged in a module in a franking machine interposed between an electronic accounting mechanism and a printing mechanism, the rotatable members may be thumb wheels connected to set encoding switches and printing elements, such as printing wheels, in accordance with any value to which the thumb wheels are positioned, the said function then being the printing of the value by the printing elements. In this arrangement the trip member, such as a lever, on being moved from the first position to the second position may be arranged to actuate a clutch to drive the printing elements through a printing cycle in which the set value is printed.

In order that the invention may be clearly understood and readily carried into effect, apparatus in accordance therewith will now be described.

DESCRIPTION OF PREFERRED EMBODIMENT

Figure 1:
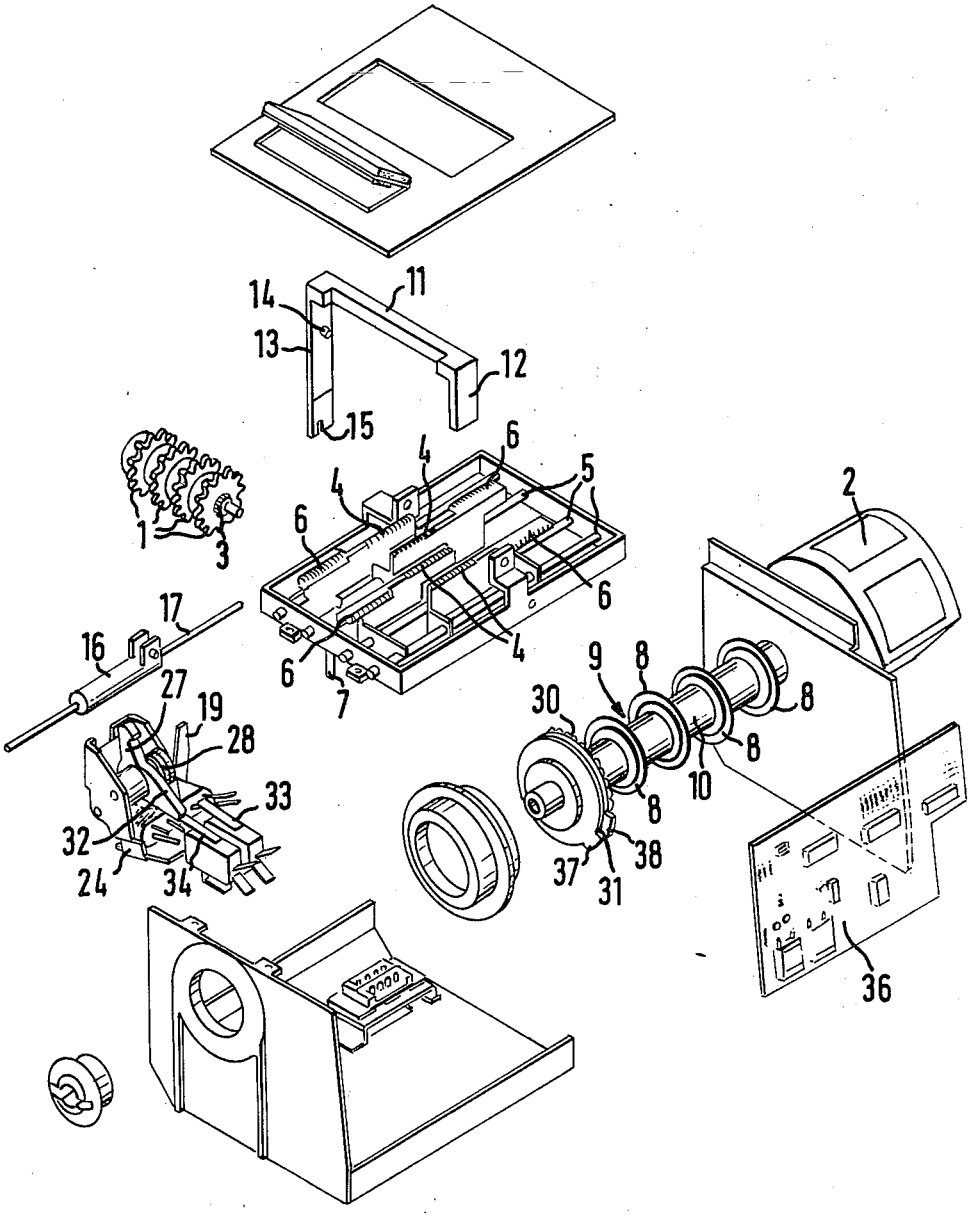
FIG. 1 is an exploded perspective view of a mechanical/electronic interface assembly for a franking machine.
Figure 2:
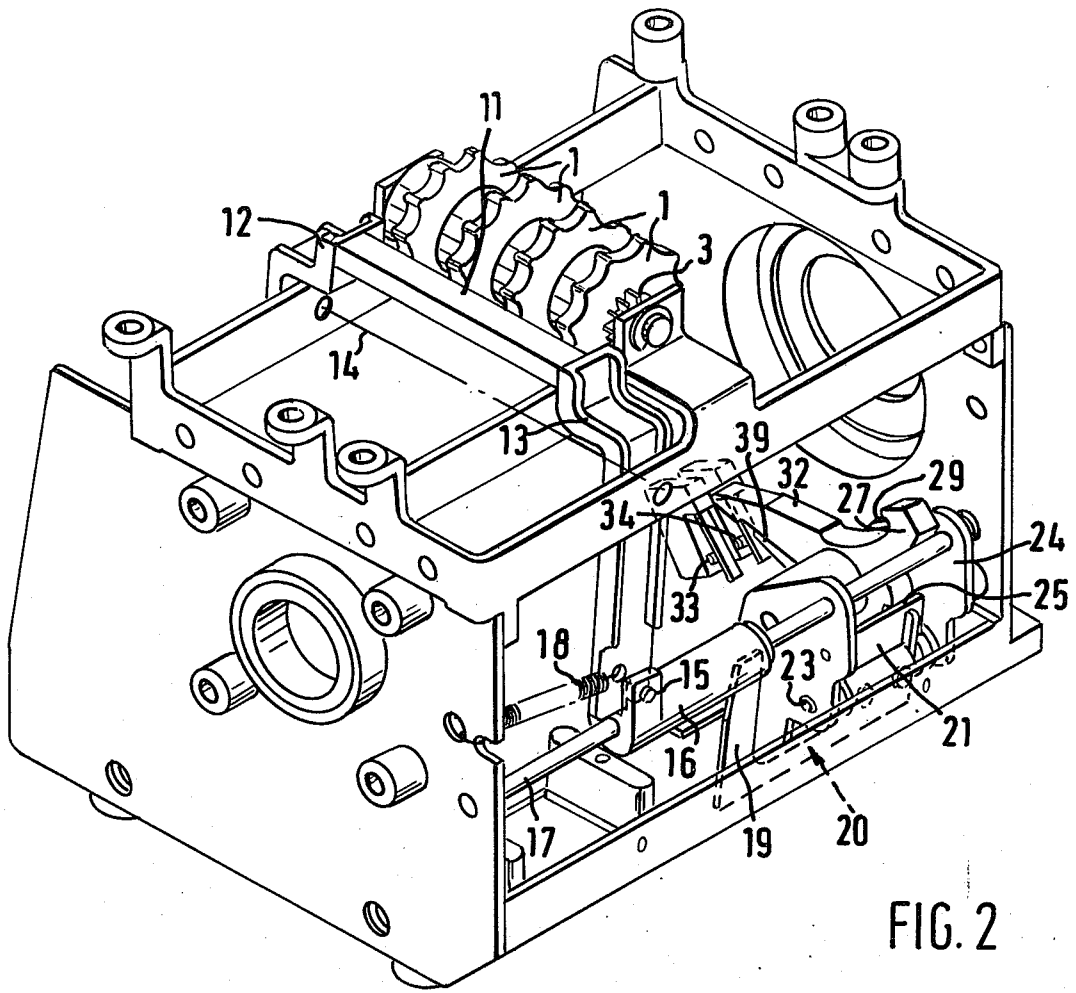
FIG. 2 is a perspective view of an assembly comprising a number of devices shown in FIG. 1.

The postage value to be franked is selected by manually rotating four thumb wheels 1, each to a position corresponding to a digit, so that a value comprising four or fewer digits can be set simultaneously in four encoded switches (not shown) and four printing wheels in a drum 2. For this purpose each thumb wheel 1 has an integral gear 3, the gears 3 being in mesh respectively with four racks 4 longitudinally movable on rods 5. Integral with each thumb wheel rack 4 is an associated one of four racks 6 in mesh with gears forming parts of the encoded switches which are as shown in copending application Ser. No. 094,240 dated Nov. 14th, 1979 of Ananthan et al. Actuation of the encoded switches provides the appropriate synchronised value input to an electronically controlled value recording unit in the machine.

Integral with each rack 4 is a shoe 7 having limbs extending over opposite faces at the edge of an associated one of four value selector rings 8 that can rotate between the shoe limbs. The selector rings 8 are centred on an arbor 9 and are respectively fixed to four printing wheel drive racks 10 nested in slots in the arbor and selectively movable in the axial direction as determined by the positioning of the selector rings 8 by the thumb wheels 1 acting through the racks 4 and shoes 7. Axial movement of the printing wheel drive racks rotates value printing wheels in the drum 2 to the positions corresponding to the setting of the thumb wheels 1. This printing wheel setting mechanism is well known in the art and, therefore, will not be further described. The value selector rings 8, the encoded switches and value printing wheels are synchronised during manufacture and designed so that they precisely retain their set relationship.

Figure 3:
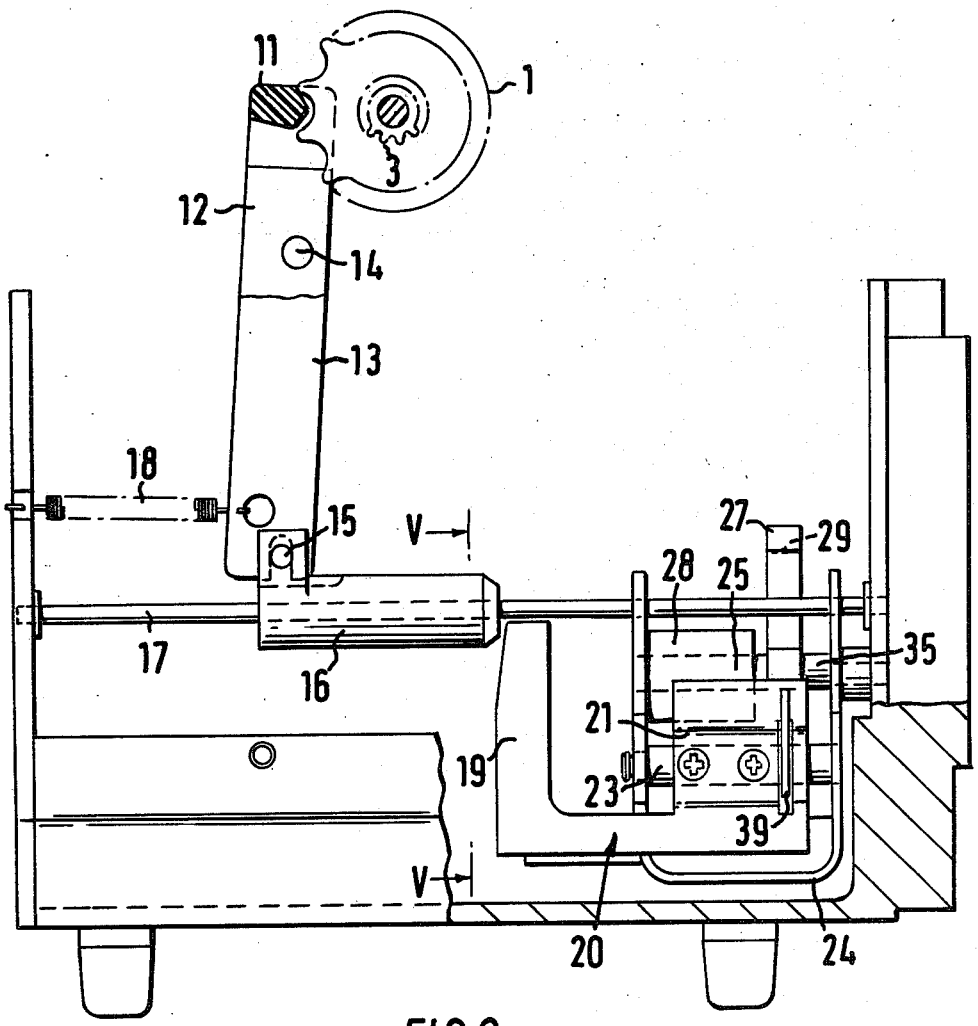
FIGS. 3 and 4 are elevations of a portion of the assembly of FIG. 2, certain parts being shown in different relative positions respectively in FIGS. 3 and 4.
Figure 4:
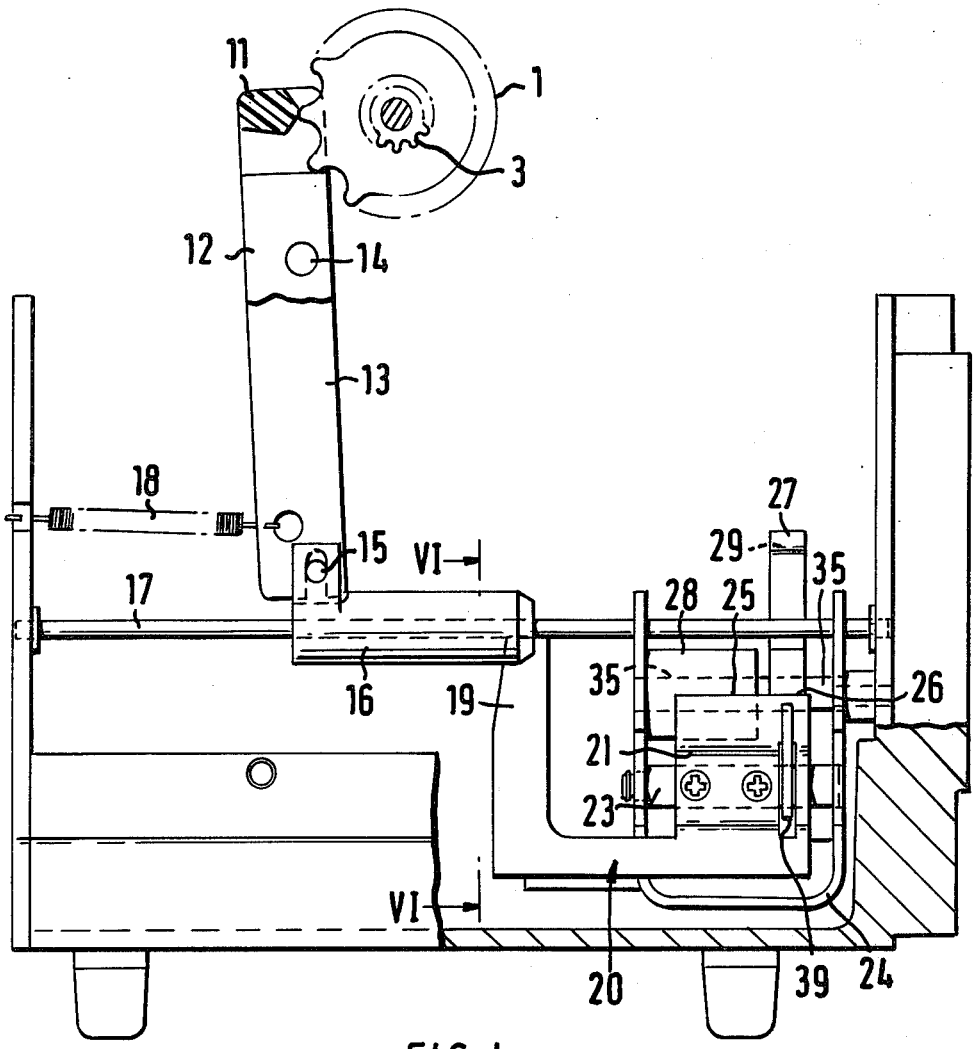
Figure 5:
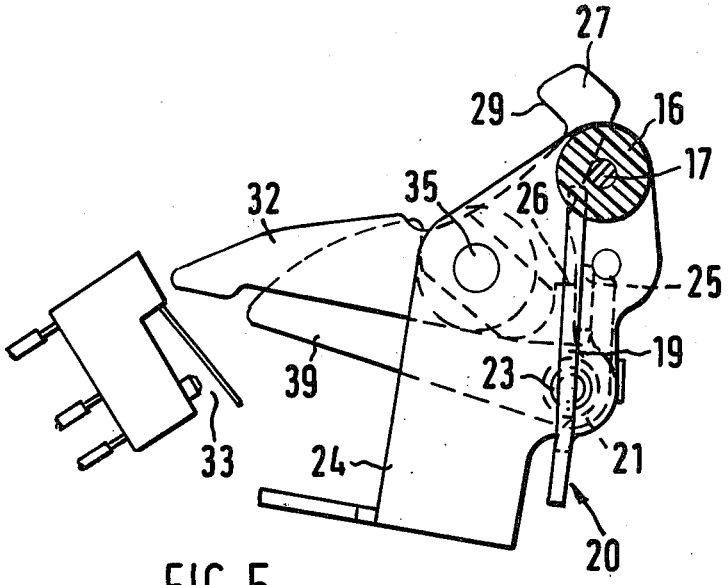
FIGS. 5 and 6 are cross-sections respectively on lines V—V and VI—VI in FIGS. 3 and 4.
Figure 6:
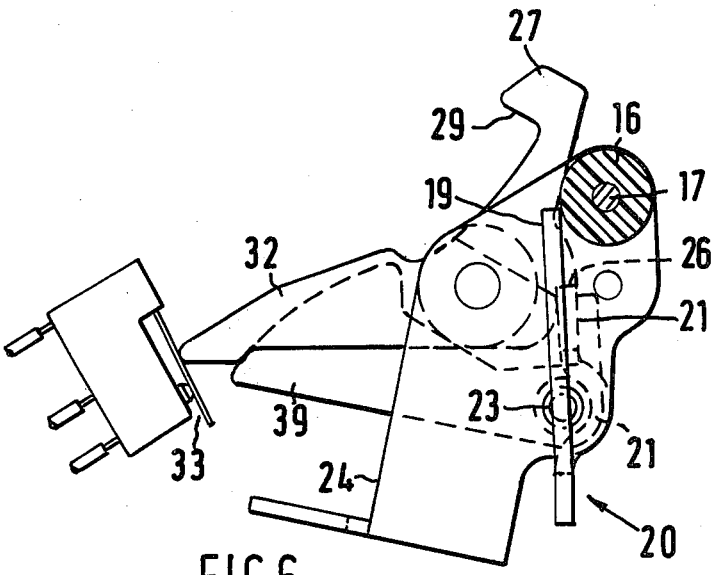

As clearly shown in the drawings, the thumb wheels 1 are formed with peripheral lobes and as the thumb wheels are rotated they snap past a horizontal locking bar 11 mounted between arms 12, 13 pivoted about an axis 14. Beneath the axis 14 the arm 13 is connected by a pin and slot connection 15 to a detent unit 16 mounted on slide on a rod 17. A tension spring 18 acting on the lever 13 maintains the locking bar 11 in contact with the thumb wheels. When the thumb wheels are all accurately set to digital values, the locking bar 11 lies between pairs of lobes on the thumb wheels as shown in FIG. 3. The detent unit 16 is then withdrawn from behind an arm 19 on a trip lever 20. On the other hand, when the locking bar 11 engages the tip of a lobe as shown in FIG. 4, the detent unit 16 is held behind the trip lever arm 19 (FIG. 6). The trip lever 20 is thus prevented from moving to the position of FIG. 5 and, as will be explained, this prevents the initiation of a printing cycle when one of the thumb wheels is incorrectly set as shown in FIG. 4. Conversely, when the thumb wheels are correctly set and a printing cycle is in progress with the trip lever 20 in the position of FIG. 5, the arm 19 limits the movement of the detent unit 16 and so locks the locking bar between the thumb wheel lobes, effectively to lock the thumb wheels in the positions to which they have been set.

In addition to the arm 19, the trip lever 20 is formed with a projection 21 fixed to a spindle 23 pivotally mounted in a U-shaped support 24 fixed in the machine. Above the spindle 23 a latching edge 25 is provided on the trip lever projection 21 and when the parts are in the positions of FIGS. 4 and 6 the latching edge 25 engages under a lip 26 on a clutch pawl 27 to hold it against the action of a spring 28 (FIG. 1).

The clutch pawl 27 which is pivoted on a spindle 35 carried by the support 24, is formed with a surface 29 for engagement with a clutch release plate lobe 38 (FIG. 1) on an engagement pawl clutch 31 (such as used in Roneo Vickers Neopost 500 franking machines) for transmitting torque from a driving shaft to the arbor 9. The clutch pawl 27 is also formed with an arm 32 which holds switches 33, 34 closed when it is in the position of FIG. 6.

A printing cycle is initiated by a signal generated when an item of mail is fed into the machine. The signal is fed to a microprocessor on an electronics panel 36 (FIG. 1) which subsequently controls a trip solenoid (not shown) to swing the trip lever 20 from the position of FIG. 6 to that of FIG. 5 (assuming that the detent unit 16 has been withdrawn from the position of FIGS. 4 and 6 to that of FIGS. 3 and 5), thereby releasing the clutch pawl to the action of the spring 28 which frees the pawl surface 29 from the clutch release plate lobe 38 (FIG. 1) so as to permit a pawl (not shown) inside the clutch 31 (FIG. 1) to engage and permit the drive to be transmitted to the printing drum 2. Simultaneously the switches 33, 34 open. This action occurs only after the microprocessor control has verified a clear status such as the availability of sufficient credit and freedom from any fault condition. As the printing cycle is completed, cam lobe 38 (FIG. 1) rotated by the driving shaft engages the clutch pawl arm 32 to reset the pawl surface 29 to the position in which it arrests both cam lobes 37, 38 to disengage the clutch pawl (not shown) inside the clutch and thereby arrest the printing drum. The clutch pawl arm 32 also engages an arm 39 pivoted at 23 so as by cam action positively to return the trip lever 20 to its latching position.

The opening and closing of the switches 33, 34 signal the initiation and completion of each printing cycle. The use of two switches facilitates self-checking should either one of them fail. The cycle initiated signal starts an accounting sequence that reads the value set in the encoding switches, adjusts the appropriate registers and reassesses whether the status of the machine is clear for the next printing cycle.

A ring of teeth 30 attached to the clutch 31 and printing drum arbor 9 together with an appropriately positioned spring assisted pawl (not shown) prevent reverse rotation of the printing drum.

It will be appreciated that the thumb wheel value selection mechanism, including the locking bar 11 and detent unit 16, provides substantial advantages over conventional devices. For example, it inhibits the printing cycle when any thumb wheel and consequently the associated printing wheel and encoding switch are incorrectly positioned either through intentional or inadvertent misuse. Moreover, the mechanism prevents a selected value from being changed after a printing cycle has been initiated even if the electric power supply to the machine has been cut off. This inhibition remains effective until the mechanism has been reset ready for the next printing cycle. In addition, the mechanism avoids the possible clash condition that can arise with some conventional locks which are forced in by an actuating cam during the early stages of a printing cycle.

I claim:

1. A value setting mechanism comprising mechanism function controlling means, a plurality of coaxially mounted relatively rotatable members each having a series of operative positions about its axis respectively representing digital values upon which the performance of a function controlled by said mechanism is to depend, and each said rotatable member being formed with a series of peripheral recesses allocated to the digital values, whereby each said recess on any said rotatable member takes up a predetermined fixed position when that rotatable member is set to the operative position corresponding to the digital value associated with the recess, a locking member mounted for to and fro movement between a first position withdrawn from said rotary members and a second position engaged in said rotatable member peripheral recesses for holding said rotatable members stationary, loading means yieldably thrusting said locking member to said second position, said locking member and said recesses being formed for said locking member simultaneously fully to enter one recess in each said rotatable member only when all said rotatable members are set to operative positions wherein each value for each rotatable member is precisely or unambiguously set at a digital value, and to be held against such entry by any said rotatable member when in an inoperative position wherein said any rotatable member is imprecisely or ambiguously set at a non-digital value, a rockable trip member having a rocking member extending outwardly from a pivot axis of said trip member, said trip member being associated with said mechanism function controlling means in a manner such that initiation and continuation of the mechanism function is controlled according to the position of said trip member, said trip member being mounted to move between a holding position completely preventing operation of said mechanism and a releasing position permitting operation of said mechanism, and a detent unit operatively connected to said locking member to move simultaneously with said locking member and mounted to slide linearly between a first position overlapping a portion of said trip lever rocking member to maintain said trip member in its holding position when said locking member engages a said rotatable member outside said recesses therein and to engage another portion of said trip member rocking member to be held by said rocking member, when in said releasing position, in a position that holds said detent unit and thereby said locking member in recesses respectively in said rotatable members, whereby said detent unit completely prevents operation of the machine when said locking bar is not properly located in said recesses and also locks said locking bar properly in said recesses once machine operation is begun.

2. A franking machine having a printing mechanism for printing values to be franked comprising mechanism controlling means, a plurality of coaxially mounted relatively rotatable members each having a series of operative positions about its axis respectively representing digital values to be selected in setting a value to be franked and each said rotatable member being manually rotatable and formed with a series of peripheral recesses allocated to the digital values, whereby each said recess on any said rotatable member takes up a predetermined fixed position when that rotatable member is set to the operative position corresponding to the digital value associated with the recess, a locking member mounted for to and fro movement between a first position withdrawn from said rotary members and a second position engaged in said rotatable member peripheral recesses for holding said rotatable members stationary, loading means yieldably thrusting said locking member to said second position, said locking member and said recesses being formed for said locking member simultaneously fully to enter one recess in each said rotatable member only when all said rotatable members are set to operative positions wherein each value for each rotatable member is precisely or unambiguously set at a digital value, and to be held against such entry by any said rotatable member when in an inoperative position wherein said any rotatable member is imprecisely or ambiguously set at a non-digital value, a rockable trip member having a rocking member extending outwardly from a pivot axis of said trip member, said trip member being associated with said mechanism function controlling means in a manner such that initiation and continuation of the mechanism function is controlled according to the position of said trip member, said trip member being mounted to move between a holding position completely preventing the setting of the printing mechanism to print a value related to the setting of said rotatable members and the operation of the machine and a releasing position permitting the setting of the printing mechanism and the operation of the machine, and a detent unit operatively connected to said locking member to move simultaneously with said locking member and mounted to slide linearly between a first position overlapping a portion of said trip lever rocking member to maintain said trip member in its holding position when said locking member engages a said rotatable member outside said recesses therein and to engage another portion of said trip member rocking member to be held by said rocking member, when in said releasing position, in a position that holds said detent unit and thereby said locking member in recesses respectively in said rotatable members, whereby said detent unit completely prevents operation of the machine when said locking bar is not properly located in said recesses and also locks said locking bar properly in said recesses once machine operation is begun.

3. A franking machine according to claim 2, including a single revolution clutch, a driving input to said clutch, and a driving connection between said clutch and said printing mechanism whereby, when said clutch is engaged, said printing mechanism is driven through a printing cycle, and means interposed between said trip member and said clutch for transmitting said movement of said trip member from said holding position to said releasing position for causing said clutch to engage to effect a printing cycle.

4. A franking machine according to claim 3, including an electrical switch for starting an accounting sequence in the machine, said means interposed between said trip member and said clutch including a clutch pawl for retaining said clutch in a disengaged condition and a spring biasing said clutch pawl to a position free from said clutch, said clutch being arranged automatically to engage on being so freed, said trip member being mounted to retain said clutch pawl in engagement which said clutch when said trip member is in said holding position and to release said clutch pawl from said clutch when said trip member is moved to said releasing position, and cam means interposed between said clutch and said clutch pawl for returning said clutch pawl to the clutch retaining position and said trip member to said holding position at the end of a printing cycle; said clutch pawl being arranged to actuate said switch for starting an accounting sequence when said clutch pawl is tripped to release free said clutch, and said trip member being arranged for movement from said holding position to said releasing position by electromagnetic action.

5. A franking machine according to claim 2, in which said trip member is a pivoted lever and said rocking member is an arm extending radially from the pivotal axis of said lever.

6. A franking machine according to claim 2, comprising as many gear wheels as said rotatable members, said gear wheels being allocated respectively to said rotatable members and each fixed coaxially to the associated rotatable member and a set of as many racks as said gear wheels, respectively in mesh therewith, and means connecting said racks to said printing mechanism for setting said printing mechanism to print values corresponding to the setting of said rotatable members.

7. A franking machine according to claim 6, including a second set of racks respectively fixed to said racks in said first set and arranged for setting encoded switches according to the setting of said rotatable members.

* * * * *